US008413552B2

(12) United States Patent
Whipstock

(10) Patent No.: US 8,413,552 B2
(45) Date of Patent: Apr. 9, 2013

(54) FASTENER SOCKET HOLDER

(75) Inventor: Craig Whipstock, Garden City, MI (US)

(73) Assignee: Automotive Components Holdings, LLC, Dearborn, MI (US)

( * ) Notice: Subject to any disclaimer, the term of this patent is extended or adjusted under 35 U.S.C. 154(b) by 1159 days.

(21) Appl. No.: 11/943,073

(22) Filed: Nov. 20, 2007

(65) Prior Publication Data

US 2009/0126537 A1 May 21, 2009

(51) Int. Cl.
*B25B 13/06* (2006.01)

(52) U.S. Cl. ..... 81/125; 81/121.1; 81/437

(58) Field of Classification Search ..... 81/125, 81/900, 121.1, 451
See application file for complete search history.

(56) References Cited

U.S. PATENT DOCUMENTS

| | | | | | |
|---|---|---|---|---|---|
| 3,707,894 | A | * | 1/1973 | Stillwagon, Jr. | 81/125 |
| 4,898,053 | A | | 2/1990 | Russo | |
| 4,919,020 | A | | 4/1990 | Huebschen | |
| 5,154,104 | A | * | 10/1992 | O | 81/177.2 |
| 5,249,489 | A | | 10/1993 | Weisman | |
| 5,277,088 | A | * | 1/1994 | Vasichek et al. | 81/125 |
| 5,520,075 | A | * | 5/1996 | Barmore | 81/437 |
| 5,542,320 | A | | 8/1996 | Vasichek et al. | |
| 5,603,248 | A | | 2/1997 | Eggert et al. | |
| 5,916,340 | A | | 6/1999 | Forsyth | |
| 5,927,160 | A | | 7/1999 | Hsieh | |
| 6,065,909 | A | * | 5/2000 | Cook | 408/206 |
| 6,164,168 | A | * | 12/2000 | Anderson | 81/125 |
| 2002/0023521 | A1 | * | 2/2002 | Dobson et al. | 81/121.1 |
| 2004/0099103 | A1 | | 5/2004 | Vaughan | |

* cited by examiner

*Primary Examiner* — Monica Carter
*Assistant Examiner* — M. Alexander
(74) *Attorney, Agent, or Firm* — MacMillan, Sobanski & Todd, LLC

(57) ABSTRACT

A socket assembly is provided for receiving and retaining a head of a fastener. The socket assembly includes a socket body having a longitudinal interior chamber defined by interior walls. The interior chamber extends axially within the socket body to a receiving end of the socket body. The interior walls of the interior chamber are configured to a shape of the head of a fastener for receiving the head of the fastener at the receiving end. A magnet is disposed within the interior of the socket body. The magnet is selectively movable in an axial direction within the interior chamber of the of the socket body. A fastening member is radially engaged to the socket body. The fastening member is configured to releasably secure the magnet within the socket body at a selected axial position in relation to the head of the fastener inserted within the receiving end.

15 Claims, 3 Drawing Sheets

FASTENER SOCKET HOLDER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISC APPENDIX

Not Applicable

BACKGROUND OF THE INVENTION

1. Field of Invention

This invention relates in general a fastener socket, and in particular to, a magnetic fastener socket for a power tool.

2. Background of Related Art

Socket holders for power driven tools such as a wrench typically include a socket body having a receiving end for receiving a head of a fastener insertable therein for driving the fastener, such as a bolt, to secure a component or assembly. It is also common to have a magnet permanently fixed within the socket assembly so that the fastener may be retained within the receiving end of the socket assembly. This allows the operator of not having to use their hands to manually hold the fastener within the receiving end of the socket assembly until the fastener is partially secured to the component.

As is typical of most socket assemblies, the receiving end of the socket assembly begins to the wear after time due to the frictional forces that the socket assembly exerts on the fastener head during the fastening operation. Since the conventional magnet is permanently fixed within the socket assembly, the end of the magnet stays at a fixed distance from the original location of the tip of the socket. As the receiving end of the socket assembly is intentionally ground down during its maintenance to restore a clean edge, the loss of material at the receiving end of the socket assembly reduces the axial length of the space remaining for the fastener head (i.e., the distance between the end of the magnet and the end of the socket). That is, the axial length of the receiving end between the magnet and the opening is now reduced, and as a result, the head of the socket may be inadequately retained within the receiving end which could result in the fastener slipping (i.e., rotating) within the socket assembly. If such conditions occur, the socket assembly is no longer useful as it is not able to adequately drive the fastener.

BRIEF SUMMARY OF THE INVENTION

The present invention has the advantage of being able to adjust the magnet within the socket so that the socket may be re-utilized after grinding operations so that a same axial space may be maintained for the fastener head between the end of the socket and the magnet within the socket assembly. A magnet within the socket assembly is axially slideable within the socket assembly when in an unsecured state and is in a fixed position when in a secured state. After a receiving end is ground down, the magnet may be axially adjusted within the socket assembly to compensate for the removed material so that a head of a fastener may be properly received therein.

In one aspect of the present invention, a socket assembly is provided for receiving and retaining a head of a fastener. The socket assembly includes a socket body having a longitudinal interior chamber defined by interior walls. The interior chamber extends axially within the socket body to a receiving end of the socket body. The interior walls of the interior chamber are configured to a shape of the head of a fastener for receiving the head of the fastener at the receiving end. A magnet is disposed within the interior of the socket body. The magnet is selectively movable in an axial direction within the interior chamber of the of the socket body. A fastening member is radially engaged to the socket body. The fastening member is configured to releasably secure the magnet within the socket body at a selected axial position in relation to the head of the fastener inserted within the receiving end.

In yet another aspect of the present invention, a method is provided for adjusting a magnetic socket assembly to a fastener head of a fastener. A magnet disposed with the socket assembly is unsecured. A fastener head is inserted in a receiving end of the socket assembly. The magnet is axially adjusted in the direction of the receiving end until the magnet contacts the head of the fastener. The magnet is releasably secured within the socket assembly for preventing axial movement of the magnet.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
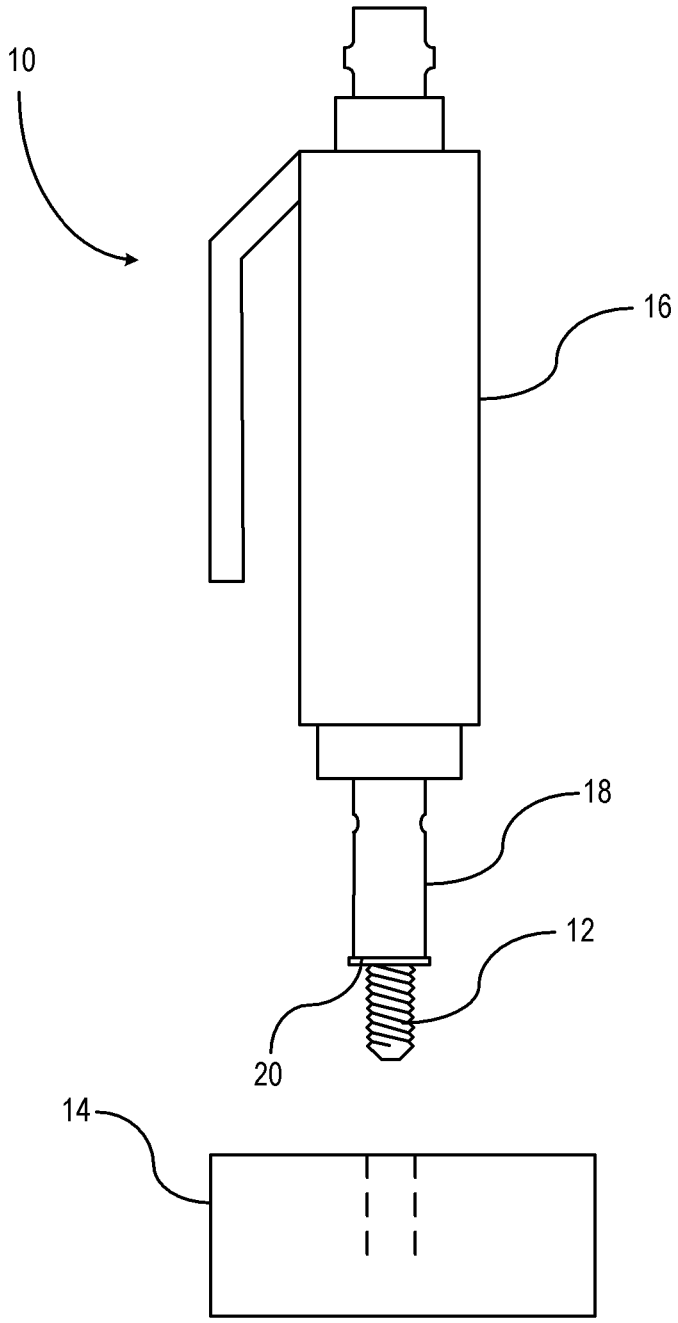
FIG. 1 is a perspective view of a fastener driving assembly according to the present invention.

Referring now to the drawings, there is illustrated in FIG. 1 a fastener driver assembly 10 for driving a fastener 12 into a component 14 or similar assembly. The fastener driver assembly 10 includes a power driven fastener driver 16, such as an industry pneumatic or electrical screwdriver, as is known in the art. The power driven screwdriver 16 may include a hand held powered screwdriver, machine driven screwdriver, or other similar screw driver that is adapted to drive the fastener 12. A socket assembly 18 is secured to the power driven screwdriver 16. The socket assembly 18 includes a receiving end for receiving the fastener 12 and maintaining the fastener 12 in the shown orientation so that the power driven screwdriver 16 may retain the fastener 12 while driving the fastener 12 into the component 14 without an operator having to manually hold the fastener until secured.

Figure 2:
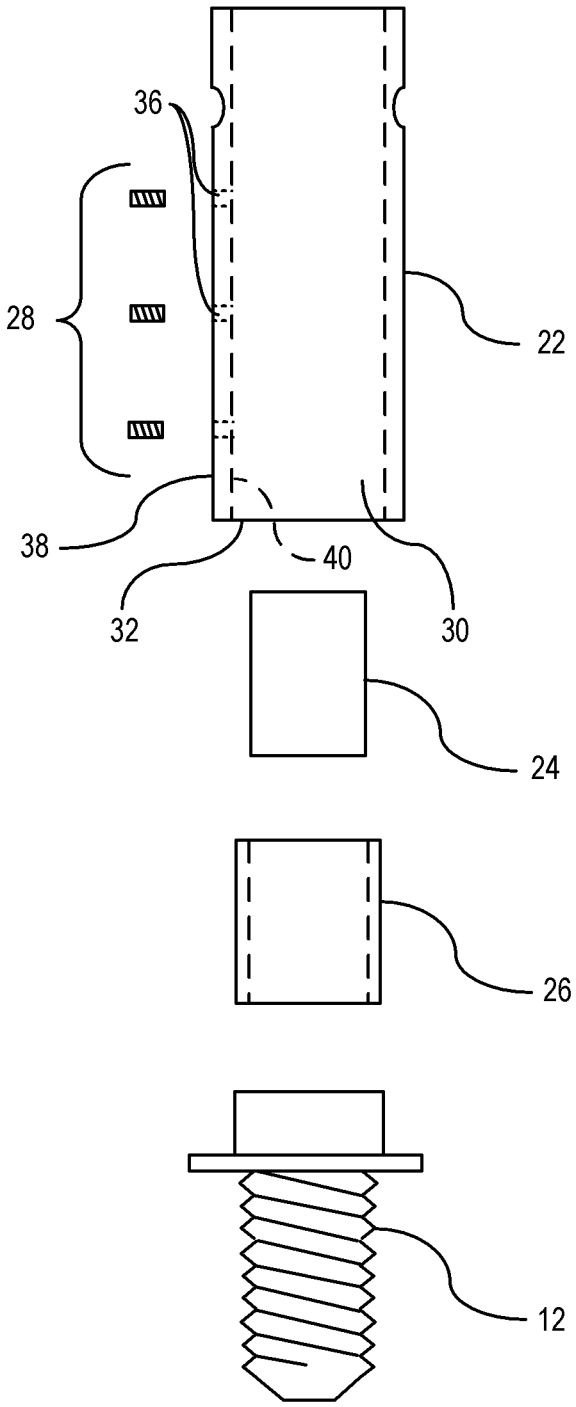
FIG. 2 is an exploded view of the socket assembly and fastener according to the present invention.

FIG. 2 illustrates an exploded view of the socket assembly 18 and retained fastener 12. The socket assembly 18 includes a socket body 22, a magnet 24, preferably a sleeve disposed around the magnet 26, and at least one fastening member 28.

Figure 3:
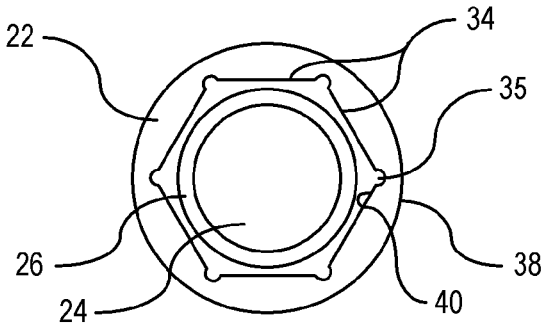
FIG. 3 an end view of the socket assembly according to the present invention.

The socket body 22 includes longitudinal interior chamber 30 extending axially through the socket body 22 to the receiving end 32. The interior chamber 30 is defined by a plurality of interior walls 34 as shown in FIG. 3. The plurality of interior walls 34 are configured to a shape of a polygon which is substantially similar to the shape of the head of the fastener 12. The head of the fastener 12 is received in the receiving end 32. The intersection of the at least two of the interior walls 34 may be fluted axially. Flutes 35 with extend axially at the intersection increase the permeability of the magnet 24 acting on the head of the fastener 22 inserted therein.

Referring again to FIGS. 2 and 3, the socket body 22 further includes a plurality of through holes 36 spaced axially along the socket body 22. The plurality of through holes extends in a radial direction from an exterior surface 38 of the socket body 22 to the interior surface 40 of the socket body 22. The through holes 36 are preferably threaded for receiving the fastening member 28 therethrough. Preferably, the fastening member 28 includes at least one set screw for mating with the through holes 36 to secure the magnet at a respective axial position within the interior chamber 30. More than one set screw may be utilized to secure the magnet 24 at a respective axial position.

The magnet 24 is disposed within the interior chamber 30 of the socket body 22. The magnet 24 is preferably a permanent magnet or rare earth magnet for generating an electromagnetic field that retains the fastener 12 within the receiving end 32 of the socket assembly 18. The magnet 24 is preferably cylindrical shaped and is axially slideable within the interior chamber 30 of the socket body 22.

The sleeve 26 is preferably made from a substantially non-magnetic material (e.g., non-metal or non-magnetic metal) and is disposed within the interior chamber 30. The sleeve 26 is cylindrical shaped and is disposed around the magnet 24 for forming a shell about the cylindrical outer surface of the magnet 24. Preferably the sleeve 26 has the same axial length as the magnet 24. The sleeve 26 is affixed to the magnet 24 for maintaining a spaced relationship between the interior walls 34 of the socket body 22 and the magnet 24. The sleeve 26 being affixed to the magnet 24 is slideable as the magnet 24 is displaced. The sleeve 26 minimizes the magnetic field between the magnet 24 and the interior walls 34 of the socket body 34 (i.e., when the socket body is made from a substantially magnetic material) so that the magnet 24 may be axially moveable within the interior chamber 30.

Figure 4:
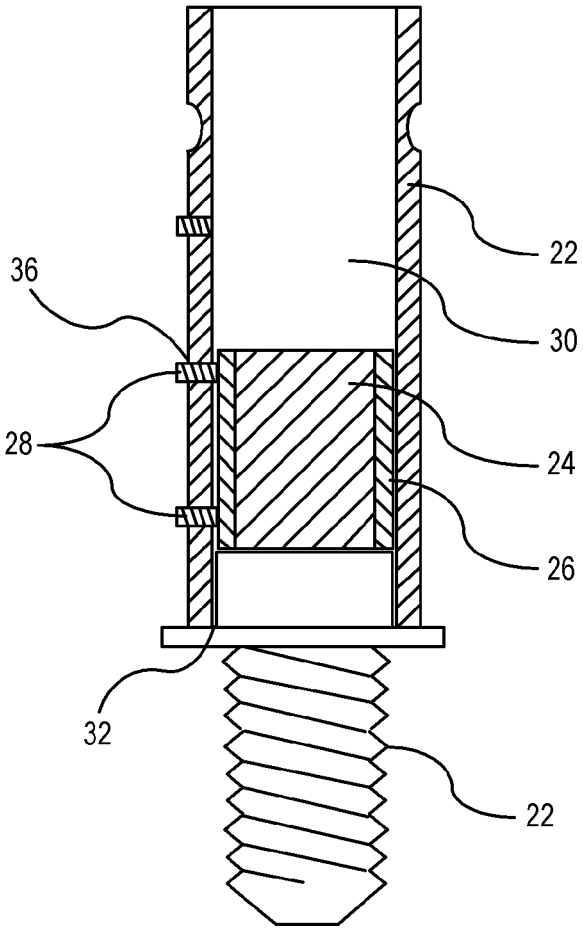
FIG. 4 is a cross section view of socket assembly according to the present invention.

FIG. 4 illustrates a cross section view of the socket assembly 22 retaining the fastener 12. The adjoined magnet 24 and sleeve 26 are moveable within the interior chamber 30 of the socket body 22 for adjusting to the height of the head of the fastener 12. Axially adjusting the magnet 24 may be performed when a screw having a different axial length head is used or when the socket body 33 is grinded after wear. That is, after a socket has been used over a period of time, the receiving end 32 wears due to the repeated torque applied to the fasteners. When the wear exhibited on the receiving end 32 results in the head of the fastener slipping on the fastener head, the receiving end 32 may be ground down to eliminate the worn portion of the receiving end 32. As a result, the axial length from the receiving end 32 to the magnet (i.e., as last positioned) is shorter than the axial length of the head of the fastener 12. To accommodate this discrepancy in length, the magnet 24 is axially moved to adjust to the length of the head of the fastener 12 from the newly ground surface of the receiving end 32.

To adjust the magnet 24 (and adjoined sleeve 26), the fastening member 28 is loosened to unsecure the magnet 24. The head of the fastener 12 is fully inserted within the receiving end 32 of the socket body 22. The magnet 24 is axially adjusted so that the magnet 24 is in contact with the top surface of the head of the fastener 12. The fastening member 28 is tightened to secure the magnet 12 within the interior chamber 30 of the socket body 22. The fastening member 28 when tightened extends through the through holes 36 and contacts the sleeve 26 for applying a compression force to the sleeve 26 (and magnet 24) between the at least one fastener 29 and at least one of the interior walls of the socket body 22. This selective positioning of the magnet 24 allows the socket body 22 to be repeatedly re-grinded after wear becomes prevalent.

Grinding the receiving end 32 of the magnet 24 may be performed while the magnet is secured within the interior chamber 30 of the magnet 24, or alternatively, the magnet 24 may be removed from the interior chamber 30 prior to regrinding the receiving end 32 of the socket body 22.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A socket assembly for receiving and retaining a head of a fastener, the socket assembly comprising:

a socket body having a longitudinal interior chamber defined by interior walls, the interior chamber extending axially within the socket body to a receiving end of the socket body, the interior walls of the interior chamber being configured to a shape of the head of a fastener for receiving the head of the fastener at the receiving end;

a magnet disposed within the interior of the socket body, the magnet being selectively movable in an axial direction within the interior chamber of the socket body; and a fastening member radially engaged to the socket body, the fastening member having a securing position to secure the magnet within the socket body at a selected fixed axial position in relation to the head of the fastener inserted within the receiving end and a loosened position to adjust the magnet to a different fixed axial position in response to a change in an axial length of the socket body.

2. The socket assembly of claim 1 wherein the interior walls of the interior chamber form a polygon, and wherein the intersection of at least two of the respective interior walls is axially fluted for increasing the magnet field acting on the head of the fastener inserted within the receiving end.

3. The socket assembly of claim 1 wherein the fastening member includes a set screw.

4. The socket assembly of claim 3 wherein the socket body includes a threaded hole extending from an exterior wall of the socket body to an interior wall of the socket body, wherein the threaded hole receives the set screw for securing the magnet at a respective axial position within the interior chamber.

5. The socket assembly of claim 4 wherein the socket body includes a plurality of threaded holes axially spaced along the socket body, each of the threaded holes are configured to receive the set screw for axially positioning and securing the magnet within the interior chamber.

6. The socket assembly of claim 5 wherein the fastening member includes at least two set screws, the at least two set screws being inserted within at least two of the plurality of threaded holes to secure the magnet at a respective axial position within the socket body.

7. The socket assembly of claim 6 wherein the socket body is formed of a magnetic metal, the socket assembly further comprising a non-magnetic sleeve disposed within the interior chamber of the socket body, and wherein the magnet is disposed within the sleeve for axially guiding the magnet within the interior chamber.

8. The socket assembly of claim 6 further comprising a substantially non-magnetic sleeve disposed between the interior walls of the chamber and the magnet, the sleeve being affixed to the magnet and moveable with the magnet.

9. The socket assembly of claim 8 wherein the magnet is cylindrical, and wherein the sleeve forms a shell about a cylindrical portion of the magnet.

10. The socket assembly of claim 7 wherein an axial length of the sleeve is substantially the same as an axial length of the magnet.

11. The socket assembly of claim 7 wherein the non-magnetic sleeve is made of a metal.

12. The socket assembly of claim 7 wherein the non-magnetic sleeve is made of a non-metal.

13. The socket assembly of claim 1 wherein the receiving end of the socket body receiving the head of the fastener is capable of regrind after wear, the magnet being selectively moved in an axial direction within the socket body for adjusting to the length of the head of the fastener after a respective regrind operation.

14. The socket assembly of claim 1 wherein the magnet is a permanent magnet.

15. The socket assembly of claim 1 wherein the magnet is a rare earth magnet.

* * * * *